US009131825B2

(12) United States Patent
Tameishi

(10) Patent No.: US 9,131,825 B2
(45) Date of Patent: Sep. 15, 2015

(54) DISHWASHING MACHINE

(75) Inventor: Yoshimasa Tameishi, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 1940 days.

(21) Appl. No.: 11/912,500

(22) PCT Filed: Dec. 8, 2005

(86) PCT No.: PCT/JP2005/022565
§ 371 (c)(1),
(2), (4) Date: Oct. 24, 2007

(87) PCT Pub. No.: WO2006/117893
PCT Pub. Date: Nov. 9, 2006

(65) Prior Publication Data

US 2009/0031848 A1 Feb. 5, 2009

(30) Foreign Application Priority Data

Apr. 27, 2005 (JP) ..... 2005-130307

(51) Int. Cl.
*F16C 7/02* (2006.01)
*A47L 15/00* (2006.01)

(52) U.S. Cl.
CPC ..... *A47L 15/0081* (2013.01); *Y10T 74/2142* (2015.01)

(58) Field of Classification Search
USPC ..... 74/579 R; 134/56 D, 186; 296/36; 16/50
See application file for complete search history.

(56) References Cited

U.S. PATENT DOCUMENTS

| | | | | | |
|---|---|---|---|---|---|
| 678,790 | A | * | 7/1901 | Nashawg | 16/66 |
| 3,001,227 | A | * | 9/1961 | Long et al. | 16/290 |
| 3,049,391 | A | * | 8/1962 | Fox et al. | 312/272 |
| 3,279,874 | A | * | 10/1966 | Noren et al. | 312/319.1 |
| 3,846,615 | A | * | 11/1974 | Athey et al. | 392/441 |
| 3,949,772 | A | * | 4/1976 | Hartmann | 134/99.1 |
| 4,147,559 | A | * | 4/1979 | Fraula et al. | 134/57 D |
| 4,187,122 | A | * | 2/1980 | Query | 134/95.3 |
| RE30,478 | E | * | 1/1981 | Fraula et al. | 134/57 D |
| 4,811,997 | A | * | 3/1989 | Suyama et al. | 312/228 |

(Continued)

FOREIGN PATENT DOCUMENTS

| | | | | |
|---|---|---|---|---|
| EP | 692598 | A1 * | 1/1996 | E05F 1/12 |
| EP | 0 828 767 | A1 | 8/1998 | |

(Continued)

OTHER PUBLICATIONS

International Search Report for PCT/JP2005/022565 mailed Mar. 14, 2006 (2 pages).

(Continued)

*Primary Examiner* — Vicky Johnson
(74) *Attorney, Agent, or Firm* — Osha Liang LLP

(57) ABSTRACT

This dishwasher utilizes a rod 58 whose upper end is linked to the proximal end of a rotary arm 10, and compression springs 53 and 54 linked to the proximal end of the rotary arm 10 via the rod 58. Thus, even if the compression springs 53 and 54 break, the elastic force of the compression springs 53 and 54 themselves is maintained, and furthermore, the compression springs 53 and 54 continue to be supported by the lower end of the rod 58 in a state of being positionally restricted with respect to a dishwasher main body 2. This prevents a door 7 in an open state from suddenly falling.

6 Claims, 19 Drawing Sheets

(56) References Cited

U.S. PATENT DOCUMENTS

| | | | | | |
|---|---|---|---|---|---|
| 4,938,240 | A * | 7/1990 | Lakhan et al. | 134/93 |
| 5,271,652 | A * | 12/1993 | Watanabe et al. | 296/36 |
| 5,630,438 | A * | 5/1997 | Hoover et al. | 134/201 |
| 5,896,619 | A * | 4/1999 | Koopman | 16/50 |
| 6,375,175 | B1 * | 4/2002 | Baumann et al. | 267/172 |
| 6,438,799 | B1 * | 8/2002 | Gronbach | 16/335 |
| 8,372,214 | B2 * | 2/2013 | Bittner | 134/58 D |
| 2006/0048799 | A1 * | 3/2006 | Brunswick | 134/56 D |
| 2008/0092933 | A1 * | 4/2008 | Tameishi et al. | 134/133 |

FOREIGN PATENT DOCUMENTS

| | | | | |
|---|---|---|---|---|
| JP | 61-151657 | | 9/1986 | |
| JP | 6-142028 | | 5/1994 | |
| JP | 10-234137 | A | 9/1998 | |
| JP | 11-18858 | | 1/1999 | |
| JP | 11-285464 | | 10/1999 | |
| JP | 11276406 | A * | 10/1999 | A47L 15/42 |
| JP | 2003-284664 | A | 10/2003 | |
| JP | 2005-34448 | | 2/2005 | |

OTHER PUBLICATIONS esp@cenet Patent Abstract JP11285464 dated Oct. 19, 1999 (1 page).

esp@cenet Patent Abstract JP6142028 dated May 24, 1994 (1 page).

esp@cenet Patent Abstract JP11018858 dated Jan. 25, 1999 (1 page).

Partial Machine Translation for JP Utility Model Publication No. S61-151657 dated Sep. 19, 1986 (3 pages).

Notification of Transmittal of Translation of the International Preliminary Report on Patentability (Chapter I and Chapter II of the Patent Cooperation Treaty) for International Application No. PCT/JP2005/022565, mailed on Nov. 8, 2007 (6 pages).

Office Action for Japanese Application No. 2005-130307 mailed on May 18, 2010, 1 page.

Patent Abstracts of Japan, Publication No. 2003-284664, Publication Date: Oct. 7, 2003, 1 page.

Patent Abstracts of Japan, Publication No. 10-234137, Publication Date: Sep. 2, 1998, 1 page.

Extended European Search Report for European Application No. 05814187.0-2316, mailed on Jun. 20, 2006 (6 pages).

* cited by examiner

DISHWASHING MACHINE

TECHNICAL FIELD

This invention relates to a so-called door-type dishwasher in which a washing chamber on the dishwasher main body side is opened and closed by raising and lowering a door.

BACKGROUND ART

Japanese Laid-Open Patent Application H6-142028 has been known in the past in this field of technology. The dishwasher described in this publication is a so-called door type in which the washing chamber is opened and closed by moving a door up and down by raising and lowering a handle. This dishwasher makes use of tension springs for smoothly raising and lowering the door. The upper ends of the tension springs are linked to the upper ends of left and right arms, and the lower ends of the tension springs are attached via hooks to the lower end of the rear panel of the dishwasher.

Patent Document 1: Japanese Laid-Open Patent Application H6-142028

Patent Document 2: Japanese Laid-Open Patent Application H11-285464

DISCLOSURE OF THE INVENTION

However, with the above-mentioned conventional dishwasher, since the opening and closing of the door relies greatly on the biasing force of the tension springs, if those springs should break, there is the danger that the door will fall under its own weight. In an attempt to deal with spring breakage, several tension springs have been disposed in a row along the rear face of the back panel of the washing chamber, so even if one spring should break, the other springs will prevent the door from falling (Japanese Laid-Open Patent Application H11-285464). In this case, more springs are required, and the construction becomes more complicated.

It is an object of the present invention to provide a dishwasher that has a simpler construction and also prevents the door from falling in the event that a spring should break.

The dishwasher according to the present invention is one in which a washing chamber provided on the side of a dishwasher main body is opened and closed by moving a door up and down while rotating a rotary arm disposed on a side face of the door, comprising a rod that extends in a vertical direction and is linked at its upper end to the proximal end of the rotary arm, and a compression spring that extends in a vertical direction and is disposed substantially parallel to the rod, and whose upper end is supported in a state of being positionally restricted with respect to the dishwasher main body, and whose lower end is supported by the lower end of the rod.

Because this dishwasher makes use of a rod that is linked at its upper end to the proximal end of the rotary arm, and a compression spring that is linked to the proximal end of the rotary arm via the rod, even if the compression spring should break, the elastic force of the compression spring itself is maintained, and furthermore, since the compression spring continues to be supported by the lower end of the rod in a state of being positionally restricted with respect to a dishwasher main body, the open door is prevented from suddenly falling. Moreover, a compression spring can undergo shot blasting or another such surface treatment more easily than a tension spring, so the durability of the spring can be increased. In addition, there is no need for a hook, which was required when a tension spring was used, and this is also advantageous in terms of increasing durability. Also, to deal with the possibility of spring breakage, a number of relatively long tension springs were required, and this took up considerable space, whereas a compression spring can have a shorter spring length, which is advantageous in terms of making the structure simpler and more compact. Also, since compression springs are less expensive than tension springs, manufacturing costs can also be reduced.

Also, it is favorable if the above-mentioned dishwasher further comprises a fixing member that supports the upper end of the compression spring and can be attached to and removed from the dishwasher main body. This allows the upper end of the compression spring to be fixed at a position relative to the dishwasher main body.

Furthermore, it is favorable if the fixing member, the rod, and the compression spring constitute a spring unit that can be attached to and removed from the dishwasher main body, and the spring unit is integrally equipped with the fixing member, the rod, and the compression spring. Creating a unit in this way facilitates assembly work and at the same time makes spring replacement and other such maintenance easier. A unit construction also reduces manufacturing costs.

It is also favorable if the above-mentioned dishwasher further comprises a female threaded member attached to the proximal end side of the rotary arm, wherein a male threaded member is formed at the upper end of the rod, and the male threaded member is threaded into the female threaded member. This constitution allows the spring pressure to be easily adjusted as desired by the user, after assembly of the finished produced or after its installation.

Also, it is favorable if the above-mentioned dishwasher further comprises a guide member that extends in the vertical direction and accommodates the compression spring. Employing a constitution such as this allows the spring to expand and contract linearly, so there is less unbalanced load on the spring, and less bending (buckling) of the spring itself. This improves spring stability, durability, and reliability.

With the present invention, the structure can be simplified and the door prevented from falling in the event that the spring should break.

BEST MODE FOR CARRYING OUT THE INVENTION

Figure 1:
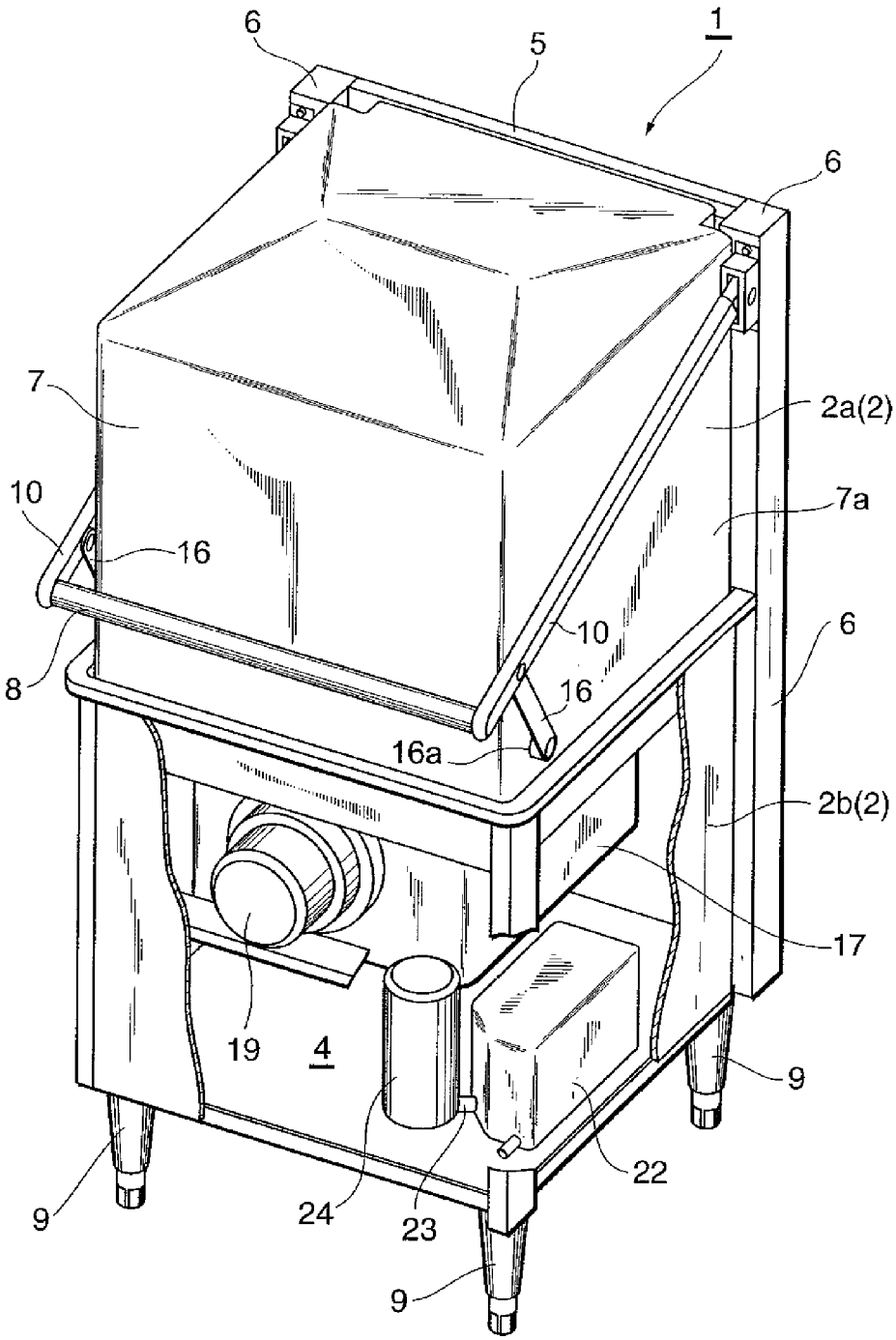
FIG. 1 is an oblique view of a first embodiment of the dishwasher according to the present invention.
Figure 2:
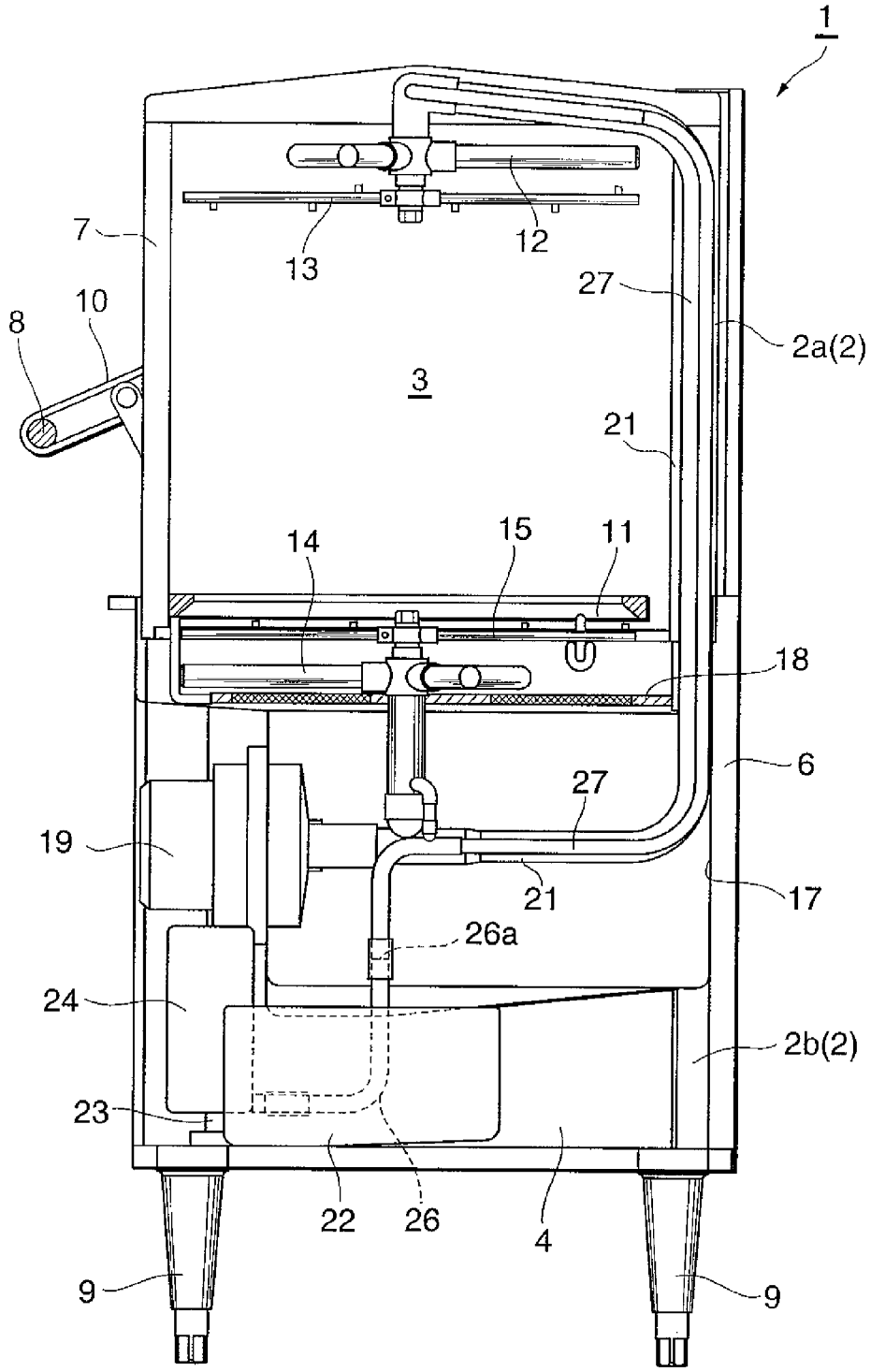
FIG. 2 is a cross section showing the internal structure of the dishwasher shown in FIG. 1.
Figure 3:
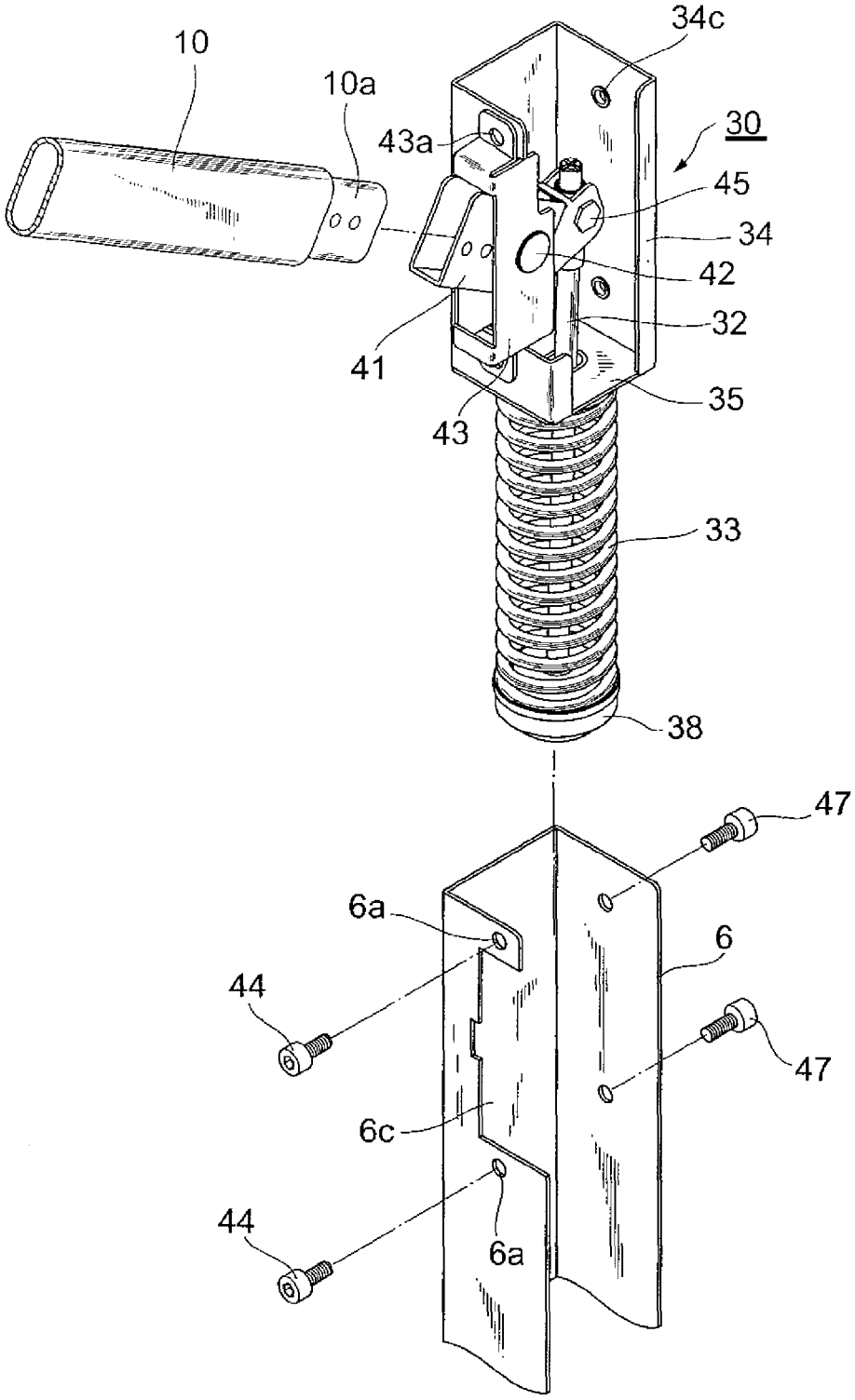
FIG. 3 is an exploded oblique view of a spring unit applied to the dishwasher of FIG. 1.
Figure 4:
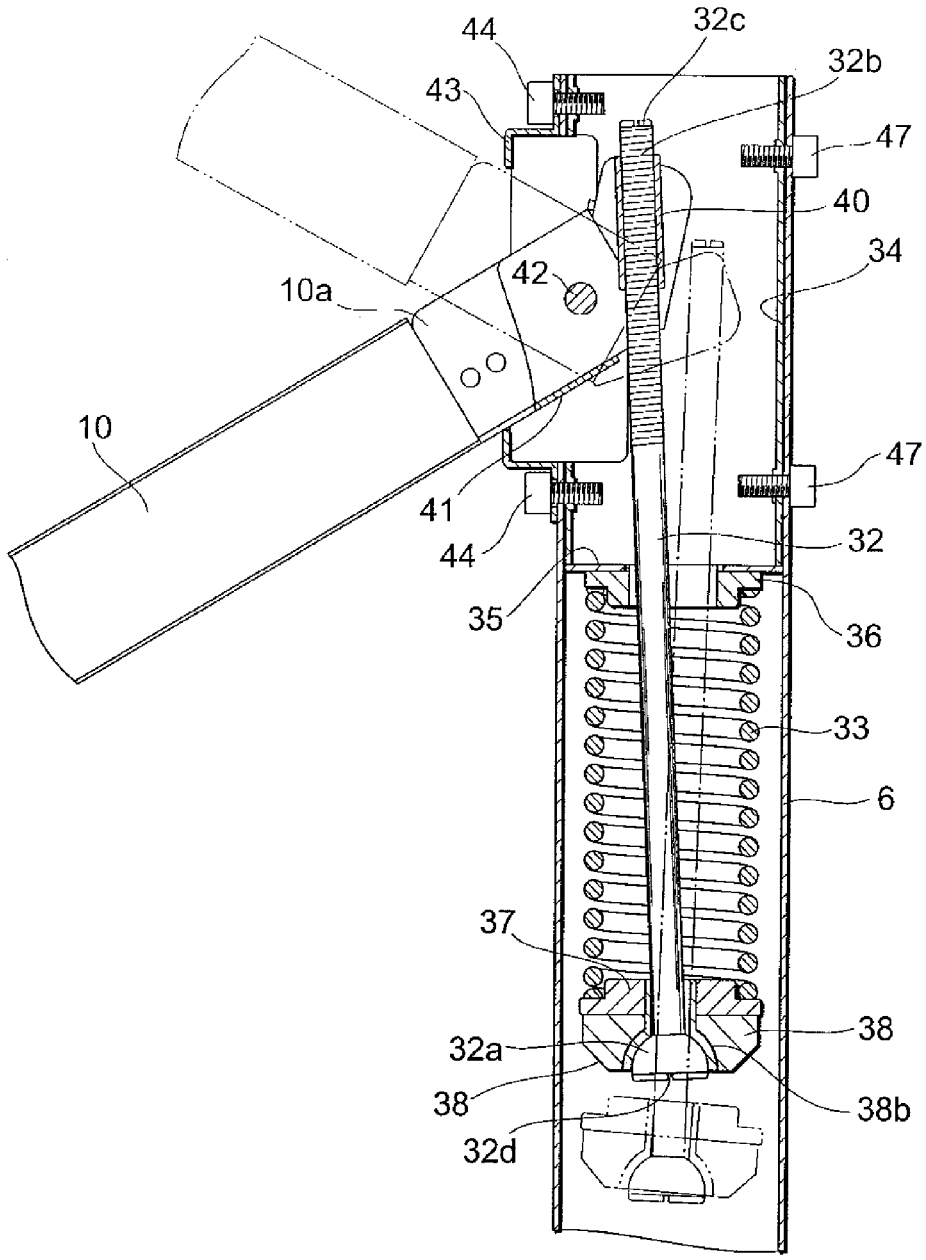
FIG. 4 is a cross section showing a spring unit mounted in a support tube.
Figure 5:
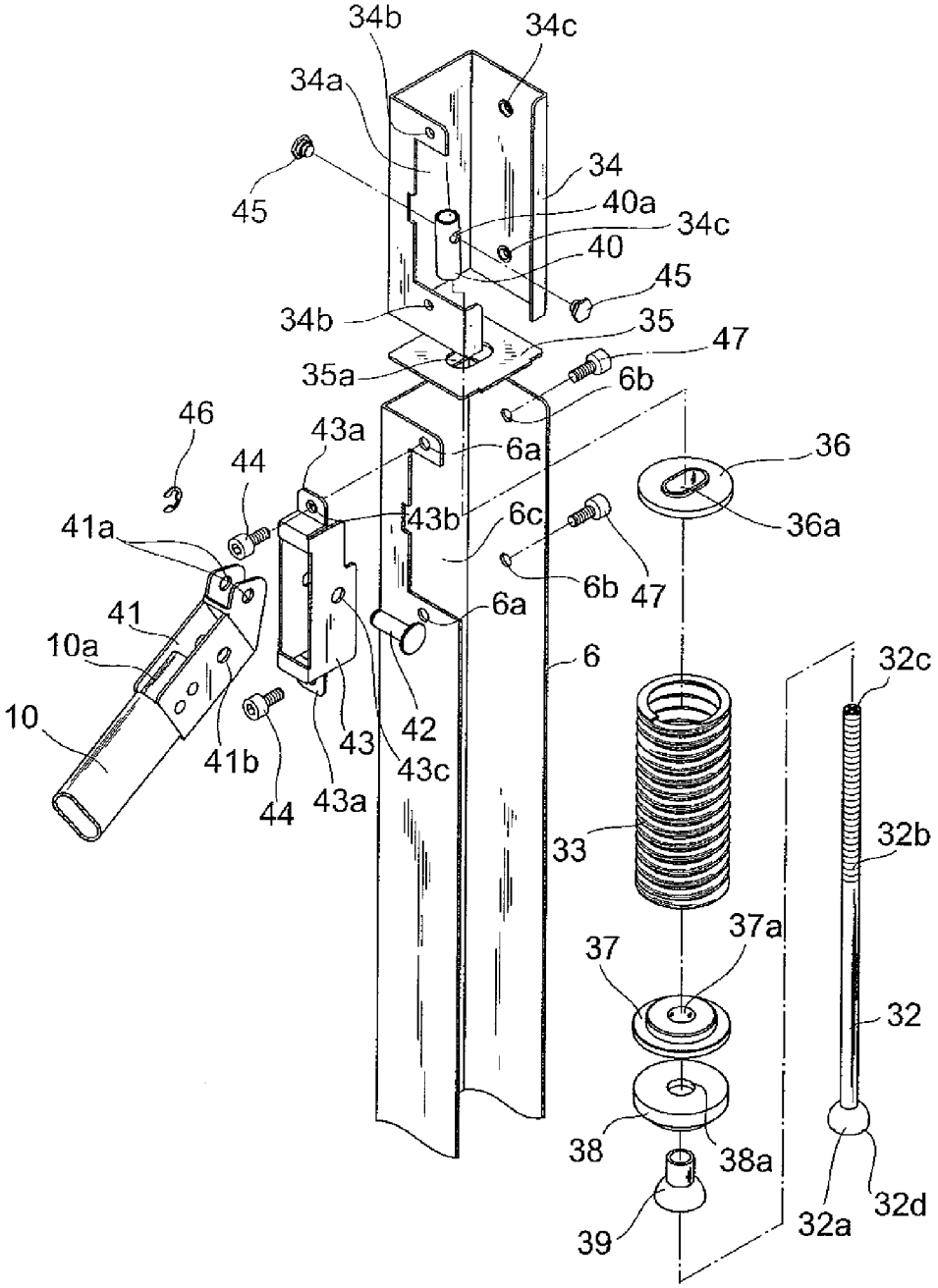
FIG. 5 is an exploded oblique view of a spring unit of the first embodiment.
Figure 6:
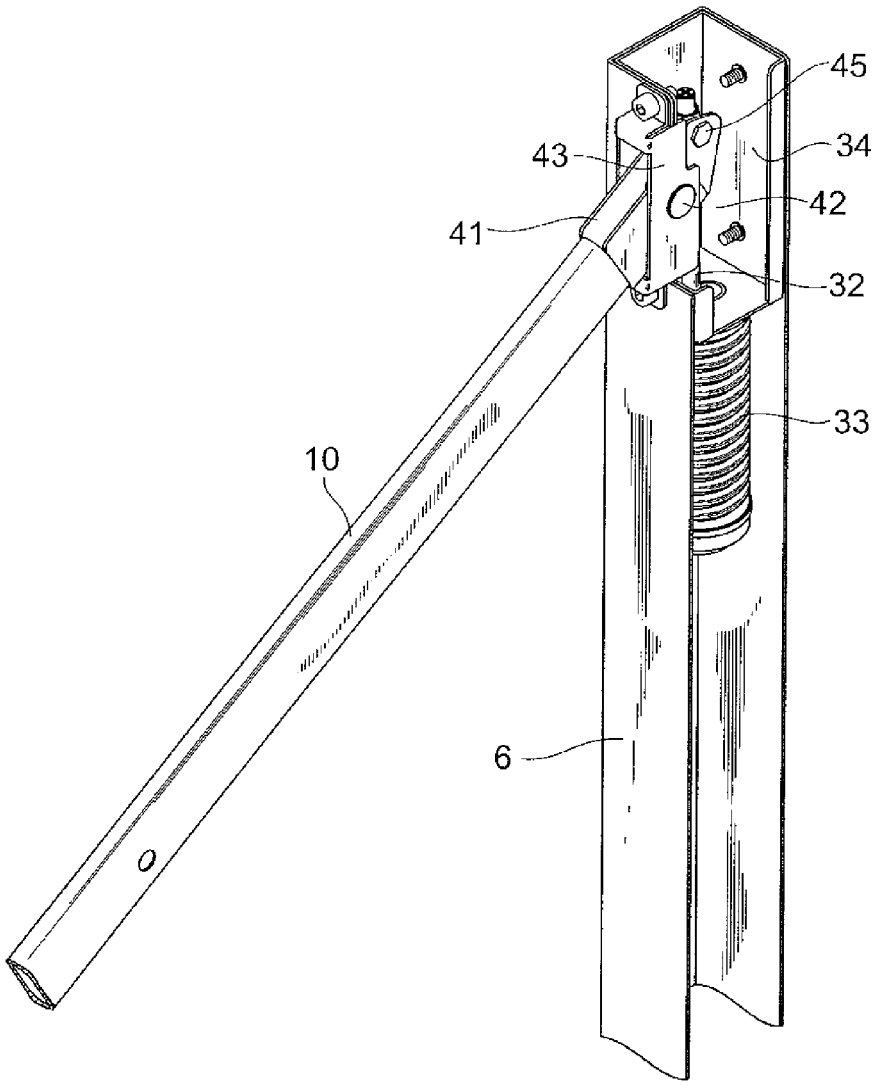
FIG. 6 is an oblique view of a rotary arm when lowered.

Preferred embodiments of the dishwasher according to the present invention will now be described in detail through reference to the drawings First Embodiment As shown in FIGS. 1 and 2, a dishwasher 1 has a stainless steel dishwasher main body 2. This dishwasher main body 2 is partitioned into an upper portion 2*a* in which a washing chamber 3 is formed, and a lower portion 2*b* in which a mechanical chamber 4 is formed. Support tubes 6 that extend in the vertical direction from the upper portion 2*a* to the lower portion 2*b* are disposed at the corners on the rear face of the dishwasher main body 2, and a rear panel 5 extends between the support tubes 6

A box-shaped door 7 for opening and closing the washing chamber 3 is provided to the upper portion 2*a* of the dishwasher main body 2. This door 7 is guided in its up and down movement by the pair of stainless steel support tubes 6, and is moved up and down by a handle 8 extending horizontally at the front. The distal ends of a pair of left and right rotary arms 10 are fixed to the ends of this handle 8, and the rotary arms 10 are disposed at an angle along the side faces 7*a* of the door 7. Since the door 7 must move up and down in conjunction with the rotational movement of the handle 8, links 16 disposed on the side faces 7*a* of the door 7 are rotatably linked at one end to the rotary arms 10, and the other ends of the links 16 are linked to the door 7 via shaft pins 16*a*. Legs 9 are attached at the four corners of the bottom face of the dishwasher main body 2, allowing the dishwasher 1 to be stably installed.

Rack rails 11 are detachably disposed inside the above-mentioned washing chamber 3, and a lattice-like dish rack (not shown) in which dirty dishes are arranged is placed on these rack rails 1. An upper washing nozzle 12 having three arms extending radially, and an upper rinsing nozzle 13 having two arms extending in a straight line are rotatably and coaxially disposed at the upper part inside the washing chamber 3. Similarly, a lower washing nozzle 14 and a lower rinsing nozzle 15 are rotatably and coaxially disposed at the lower part inside the washing chamber 3.

At the bottom of the washing chamber 3 constituted as above, a washing water tank 17 is formed so as to protrude into the mechanical chamber 4, and a filter 18 is detachably disposed between the washing chamber 3 and the washing water tank 17. A washing water supply pump (hereinafter referred to as a "washing pump") 19 is directly attached to the front face of this washing water tank 17 so that the intake port and discharge port will be located within the washing water tank 17, which reduces the number of required parts and saves space. A washing water flow pipe 21 is connected to the discharge port of this washing pump 19, and this washing water flow pipe 21 goes through the insides of the washing water tank 17 and the washing chamber 3 and is connected to the upper washing nozzle 12 and the lower washing nozzle 14.

A rinsing water tank 22 to which rinsing water is supplied from an external water heater (not shown) is held inside the mechanical chamber 4. A rinsing water supply pump (hereinafter referred to as "rinsing pump") 24 is connected to this rinsing water tank 22 via an intake port 23. This rinsing pump 24 is installed upright with its impeller on the lower side, to make more efficient use of the space inside the mechanical chamber 4. A discharge pipe 26 is connected to the discharge port of this rinsing pump 24, and an end 26*a* of this discharge pipe 26 extends into the washing water tank 17. A rinsing water flow pipe 27 is connected to the end 26*a* of the discharge pipe 26, and this rinsing water flow pipe 27 goes through the insides of the washing water tank 17 and the washing chamber 3 and is connected to the upper rinsing nozzle 13 and the lower rinsing nozzle 15. An electrical box or the like (not shown) that houses a microcomputer or the like for controlling the entire operation of the dishwasher 1 is also accommodated in the mechanical chamber 4.

As shown in FIGS. 3 to 6, compression springs 33 for opening and closing the door are mounted extending vertically inside the support tubes 6, which are in the form of rectangular pipes. These compression springs 33 are each housed in a support tube 6 as part of a spring unit 30. These spring units 30 are linked to the proximal ends of the rotary arms 10 disposed on the side faces 7*a* of the door 7.

The spring units 30 are each made up primarily of a rod 32 linked at its upper end to the proximal end of a rotary arm 10, a compression spring 33 through which the rod 32 passes and which extends in the vertical direction so as to be parallel with the rod 32, and a fixing member 34 that can be attached to or detached from the support tube 6, which supports the upper end of the compression spring 33 and forms part of the dishwasher main body 2. Also, the upper ends of the compression springs 33 are supported in a state of being positionally restricted with respect to the dishwasher main body 2. Specifically, positional restriction is accomplished by having the upper ends of the compression springs 33 strike the lower face of the fixing members 34 via rectangular partition plates 35 and disk-shaped spring bearings 36 that are in contact with the bottom of the fixing members 34. In contrast, the lower ends of the compression springs 33 are supported by the lower ends of the rods 32. Specifically, the lower ends of the compression springs 33 are supported by the lower ends of the rods 32 via disk-shaped spring bearings 37 and rod bearings 38.

Slots 36*a* and 35*a* that allow the rods 32 to pass through are provided to the above-mentioned upper spring bearings 36 and partition plates 35, and through-holes 37*a* and 38*a* for allowing the rods 32 to pass through are provided to the lower spring bearings 37 and rod bearings 38. Hemispherical catches 32*a* are provided to the lower ends of the rods 32 to avoid stress concentration, and the lower ends of the rods 32 are pressed against hemispherical seats 38*b* of the rod bearings 38 in a state in which the catches 32*a* are covered with caps 39. The rods 32 move forward and backward within the above-mentioned slots 36*a* and 35*a* according to the up and down motion of the rotary arms 10.

A male threaded member 32*b* is formed on the upper end side of each of the rods 32, and the male threaded member 32*b* is threaded into a cylindrical female threaded member 40. This makes it easier to adjust spring pressure to suit the user's preference after assembly of the finished produced or after its installation. Incidentally, spring pressure can be adjusted more easily by providing cross-shaped holes for a screwdriver in the upper and lower ends of the rods 32.

This female threaded member 40 is attached rotatably with respect to an arm joint 41 located on the proximal end side of the rotary arm 10. A shaft hole 40*a* is formed passing horizontally through the female threaded member 40, and a shaft hole 41*a* is formed passing horizontally through the arm joint 41. With the shaft hole 40*a* of the female threaded member 40 and the shaft hole 41*a* of the arm joint 41 in position, a shaft bolt 45 is fitted into the shaft holes 40*a* and 41*a*, which allows the female threaded member 40 to pivot freely within the vertical plane with respect to the rotation of the arm joint 41.

Further, a shaft hole 41*b* of the arm joint 41 and a shaft hole 43*c* of an arm holder 43 are positioned, a shaft pin 42 is inserted into the shaft holes 41*b* and 43*c*, and an E ring 46 is fitted to the distal end of the shaft pin 42, the result being that the arm joint 41 is attached rotatably with respect to the arm holder 43. Flanges 43*a* for fixing the arm holder 43 to the support tube 6 are provided to the upper and lower ends of this arm holder 43. A screw insertion hole 43*b* through which a screw 44 is passed is provided to each of the flanges 43*a*.

Furthermore, an opening 34*a* is formed in the front face of the fixing member 34 to allow the arm holder 43 to be inserted, and a female threaded member 34*b* is also provided to allow the screw 44 to be threaded in. A female threaded member 34*c* is provided to the rear face of the fixing member 34 to allow a screw 47 to be threaded in. A screw insertion hole 6*a* is provided to the front face of the support tube 6 to allow the insertion of the screw 44, and a screw insertion hole 6*b* through which the screw 47 is passes is provided to the rear face of the support tube 6.

An opening is formed at the top of each of the support tubes 6 so that the upper face is open, a detachable cap (not shown) is provided to close off this opening, and the side face of the support tube 6 is closed off by a plate (not shown). Thus giving the support tubes 6 a sealed construction makes the compression springs 33 housed in the support tubes 6 waterproof, and also provides a very clean look. Furthermore, washing water and rinsing water are less likely to adhere to the compression springs 33, so this construction is also more hygienic. The support tubes 6 may be angle tubes having four sides and a rectangular cross section.

Next, the process of assembling these spring units 30 (see FIG. 3) into the support tubes 6 will be described. First, the compression springs 33 and the fixing members 34 of the spring units 30 are inserted from above the support tubes 6, and the arm joints 41 and the arm holders 43 of the spring units 30 are allowed to protrude from the openings 6*c* formed in the front faces of the support tubes 6. After this, the arm holders 43 and the front faces of the fixing members 34 are fixed to the support tubes 6 with the screws 44, and the rear faces of the fixing members 34 are fixed to the support tubes 6 with the screws 47. The proximal ends 10*a* of the rotary arms 10 are then screwed to the arm joints 41.

Figure 7:
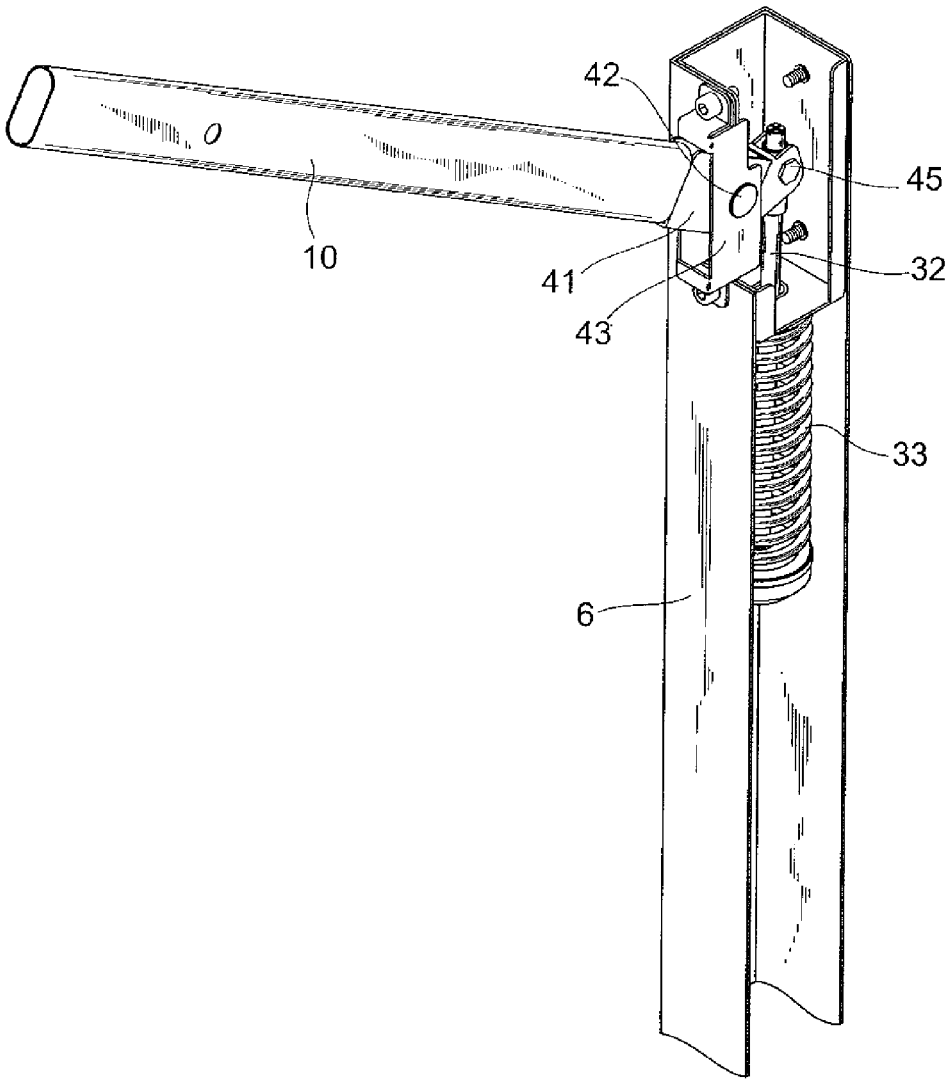
FIG. 7 is an oblique view of a rotary arm when raised.
Figure 8:
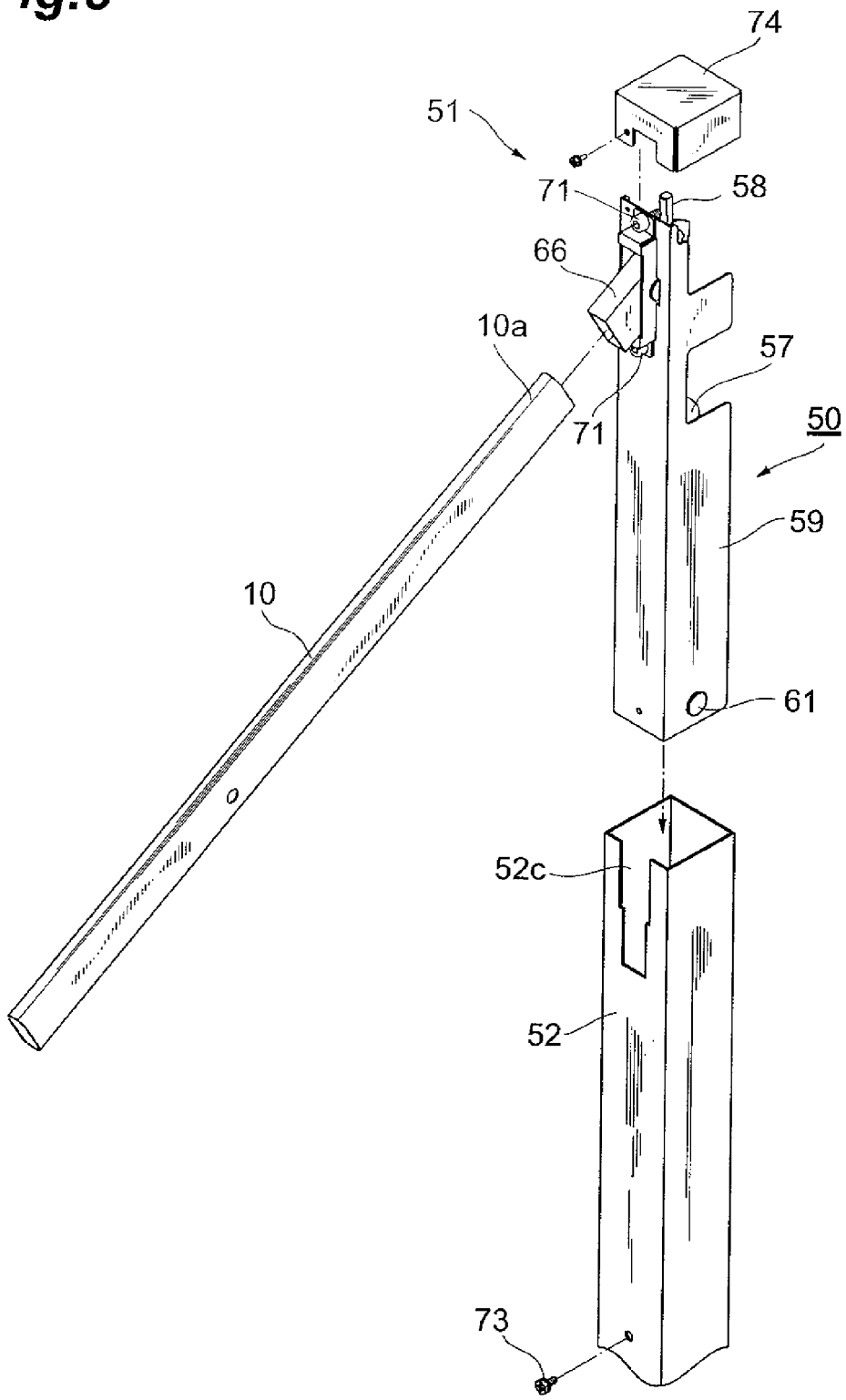
FIG. 8 is an exploded oblique view of the main components in a second embodiment of the dishwasher according to the present invention.
Figure 9:
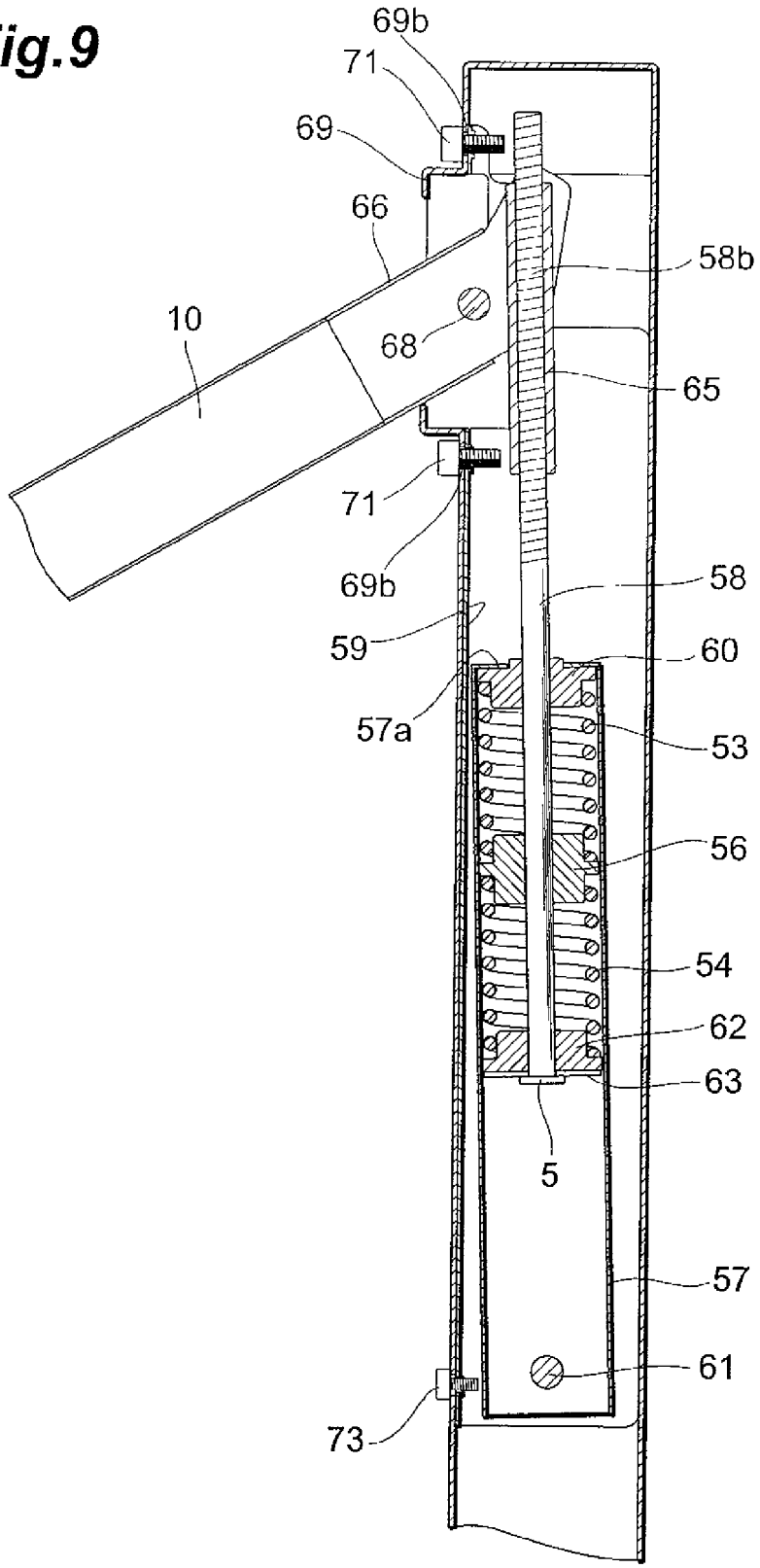
FIG. 9 is a cross section showing a spring unit mounted in a support tube.
Figure 10:
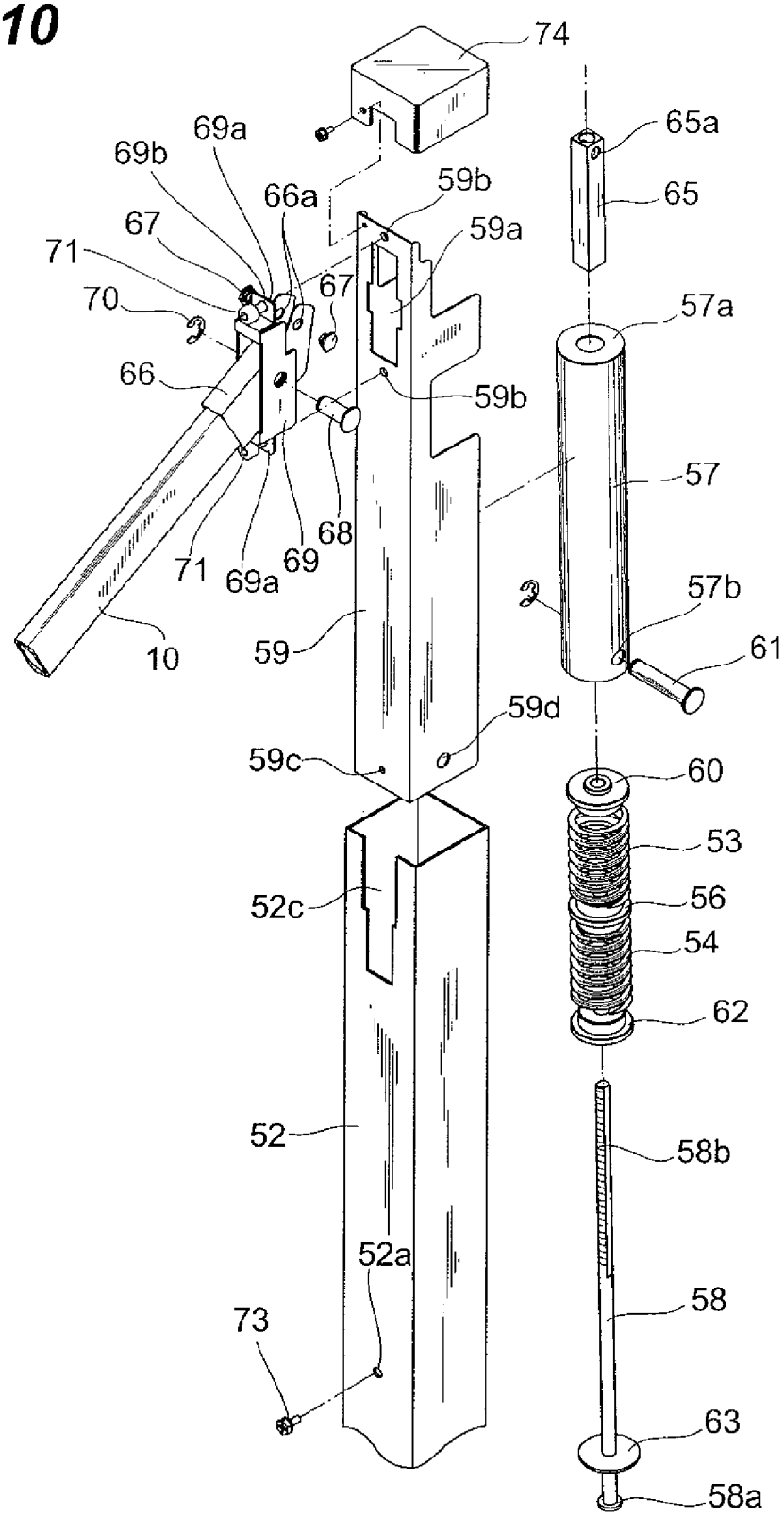
FIG. 10 is an exploded oblique view of the spring unit of the second embodiment.
Figure 11:
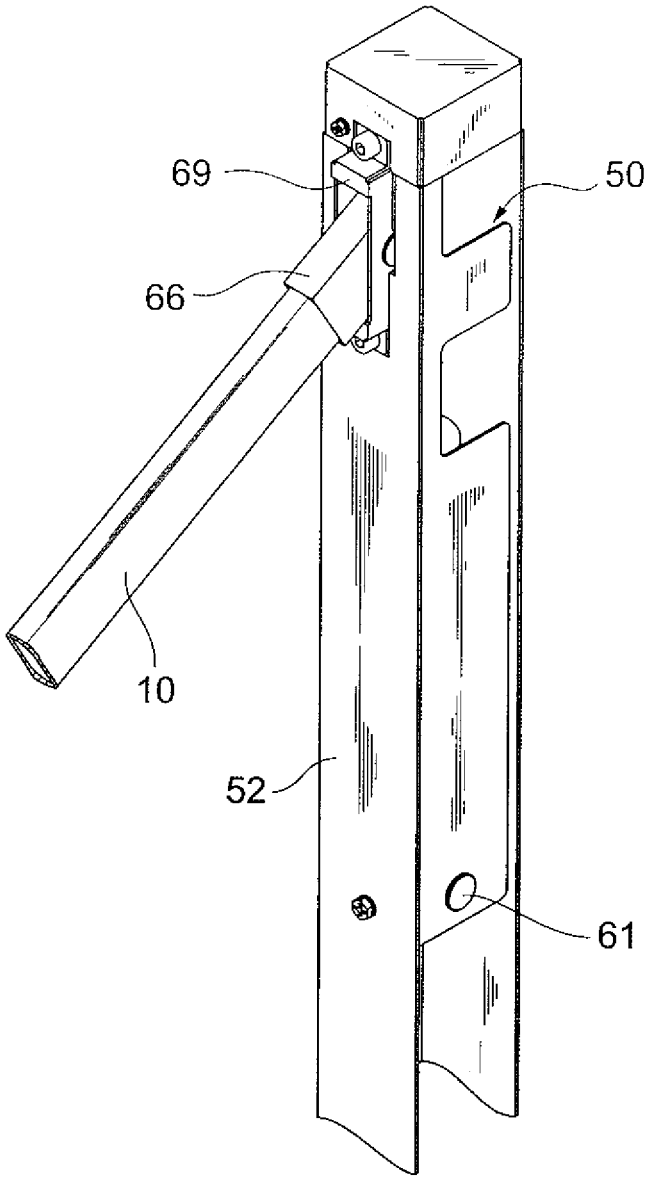
FIG. 11 is an oblique view of the rotary arm when lowered.

With the dishwasher 1 assembled in this way, when the handle 8 is grasped and the rotary arms 10 are raised, as the door 7 opens, the compression springs 33 are stretched out and exert a biasing force on the rotary arms 10, which allows the door 7 to be raised more smoothly (see FIG. 7). When the door 7 is to be closed, the rotary arms 10 are lowered, and the weight of the door 7 compresses the compression springs 33, allowing the door 7 to continue descending smoothly (see FIG. 6).

Even if the compression springs 33 should break while the dishwasher 1 is in use, the elastic force of the compression springs 33 themselves will be maintained, and furthermore the compression springs 33 will remain in their current state, so the door 7 in an open state is prevented from suddenly falling. Moreover, the compression springs 33 can undergo shot blasting or another such surface treatment more easily than tension springs, so the durability of the springs can be increased. In addition, there is no need for hooks, which were required when tension springs were used, and this is also advantageous in terms of increasing durability.

Also, to deal with the possibility of spring breakage, a number of relatively long tension springs were required, and this took up considerable space, whereas the compression springs 33 can have a shorter spring length, which is advantageous in terms of making the structure simpler and more compact. Also, since the compression springs 33 are less expensive than tension springs, manufacturing costs can also be reduced. Plus, using the above-mentioned spring units 30 facilitates assembly work. Furthermore, with a conventional dishwasher, when the springs were replaced the dishwasher had to be moved away from the kitchen wall, but since the above-mentioned spring units 30 can be detached from the support tubes 6, there is no need to move the dishwasher, and this makes maintenance work easier. A unit construction also reduces manufacturing costs. Also, since spring compression can be adjusted merely by inserting a screwdriver through the opening at the upper end of the support tube 6 and turning the rod 32, the whole dishwasher does not have to be moved away from the wall, and furthermore the spring unit does not have to be removed, so the process is extremely simple.

Second Embodiment

FIGS. 8 to 11 illustrate a dishwasher 51 of a second embodiment, in which compression springs 53 and 54 for opening and closing the door 7 are mounted so as to extend vertically within a support tube 52 in the form of a rectangular pipe. A spacer 56 is disposed between the compression spring 53 and the compression spring 54, which are paired one above the other, and the compression springs 53 and 54 are housed as part of a spring unit 50 in the support tube 52 in a state of being mounted in a guide cylinder (guide member) 57. A plastic material is affixed on the inner face of this guide cylinder 57. A plastic pipe may also be provided on the inside of the guide cylinder 57.

The spring unit 50 is made up primarily of a rod 58 that extends in the vertical direction and whose upper end is linked to the proximal end of a rotary arm 10, the compression springs 53 and 54 that extend in the vertical direction and through which the rod 58 passes parallel thereto, a fixing member 59 that can be attached to and detached from a support tube 52 that supports the upper end of the compression spring 53 and constitutes part of a dishwasher main body 2, and the guide cylinder 57 that extends in the vertical direction and houses the set of compression springs 53 and 54.

Also, the upper end of the compression spring 53 is supported in a state of being positionally restricted with respect to the dishwasher main body 2. Specifically, the upper end of the compression spring 53 is pushed against the upper end 57*a* of the guide cylinder 57 via a spring bearing 60. A shaft hole 57*b* is formed at the lower end of the guide cylinder 57, a shaft hole 59*d* is formed at the lower end of the fixing member 59, and the guide cylinder 57 is linked to the fixing member 59 by a shaft pin 61 that passes through the shaft holes 57*b* and 59*d*. As a result, the upper ends of the compression springs 53 are positionally restricted. In contrast, the lower end of the compression spring 54 is supported by the lower end of the rod 58. Specifically, the lower end of the compression spring 54 is supported by the lower end of the rod 58 via a disk-shaped spring bearing 62 and a rod bearing 63. A catch 58*a* is provided to the lower end of the rod 58, and the rod 58 passes through a spacer 56, the spring bearings 60 and 62, and the rod bearing 63.

A male threaded member 58*b* is formed on the upper end side of the rod 58, and the male threaded member 58*b* is threaded into a cuboid female threaded member 65. This allows the spring pressure to be easily adjusted as desired by the user, after assembly of the finished produced or after its installation. The upper end portion of the rod 58 is formed with a quadrangular or hexagonal cross section. Since this portion protrudes upward from the female threaded member 65, a wrench can be used to adjust spring pressure.

Also, this female threaded member 65 is attached rotatably with respect to an arm joint 66 located on the proximal end side of the rotary arm 10. A shaft hole 65*a* passes horizontally through the female threaded member 65, and a shaft hole 66*a* passes horizontally through the arm joint 66. With the shaft hole 65*a* of the female threaded member 65 and the shaft hole 66*a* of the arm joint 66 in position, a shaft bolt 67 is fitted into the shaft holes 65*a* and 66*a*, which allows the female threaded member 65 to pivot freely within the vertical plane with respect to the rotation of the arm joint 66.

Further, the arm joint 66 is rotatably attached to an arm holder 69 by a shaft pin 68, and an E ring 70 is fitted to the distal end of the shaft pin 68 to keep the shaft pin 68 from coming loose. Flanges 69*a* for fixing the arm holder 69 to the front face of the support tube 52 are provided to the upper and lower ends of this arm holder 69. A screw insertion hole 69*b* through which a screw 71 is passed is provided to each of the flanges 69*a*.

Furthermore, an opening 59*a* is formed in the at the upper part of the front face of the fixing member 59 to allow the arm holder 69 to be inserted, and a female threaded member 59*b* is also provided to allow the screw 71 to be threaded in. A female threaded member 59*c* is provided to the lower part of the front face of the fixing member 59 to allow a screw 73 to be threaded in. A screw insertion hole 52*a* through which the screw 73 is passed is provided to the front face of the support tube 52.

A cap 74 that forms the top of each support tube 52 is screwed to the top of the fixing member 59. Thus giving the support tubes 52 a sealed construction makes the compression springs 53 and 54 housed in the support tubes 52 waterproof, and also provides a very clean look. Furthermore, washing water and rinsing water are less likely to adhere to the compression springs 53, so this construction is also more hygienic.

Next, the process of assembling these spring units 50 (see FIG. 8) into the support tubes 52 will be described. First, the fixing members 59 of the spring units 50 are inserted from above into the support tubes 52, and the arm joints 66 and the arm holders 69 of the spring units 50 are allowed to protrude from the openings 52*c* formed in the front faces of the support tubes 52. At this point, the arm holders 69 are screwed to the fixing members 59 with the screws 71. After this, the fixing members 59 are fixed to the support tubes 52 with the screws 73, and the proximal ends 10*a* of the rotary arms 10 are riveted to the arm joints 66.

With the dishwasher 51 assembled in this way, when the handle 8 is grasped and the rotary arms 10 are raised, as the door 7 opens, the compression springs 53 and 54 are stretched out and exert a biasing force on the rotary arms 10, which allows the door 7 to be raised more smoothly. When the door 7 is to be closed, the rotary arms 10 are lowered, and the weight of the door 7 compresses the compression springs 53 and 54 while the door 7 descends smoothly. The rod 58 pivots as the door 7 moves up or down, and the pivoting of the rod 58 is accompanied by pivoting of the guide cylinder 57 around the shaft pin 61.

Even if the compression springs 53 and/or 54 should break while the dishwasher 51 is in use, the elastic force of the compression springs 53 and 54 themselves will be maintained, and furthermore the compression springs 53 and 54 will remain in their current state, so the door 7 in an open state is prevented from suddenly falling. Moreover, the compression springs 53 and 54 can undergo shot blasting or another such surface treatment more easily than tension springs, so the durability of the springs can be increased. In addition, there is no need for hooks, which were required when tension springs were used, and this is also advantageous in terms of increasing durability.

Furthermore, because a guide cylinder (guide member) 57 that extends in the vertical direction is used, the compression springs 53 and 54 can expand and contract linearly, and so there is less unbalanced load on the compression springs 53 and 54, and less bending (buckling) of the springs. This improves the stability, durability, and reliability of the springs 53 and 54. Also, because two springs 53 and 54 are used, shorter springs can be utilized, making buckling less likely to occur. And even if one of the springs should break, the other spring will maintain safe operation. Also, since spring pressure can be adjusted merely by taking off the cap 74, inserting a wrench through the opening at the top of the support tube 52, and turning the rod 58, there is no need to move the dishwasher away from the wall, and furthermore since there is no need to take out the spring unit, the operation is extremely simple.

Third Embodiment

Figure 12:
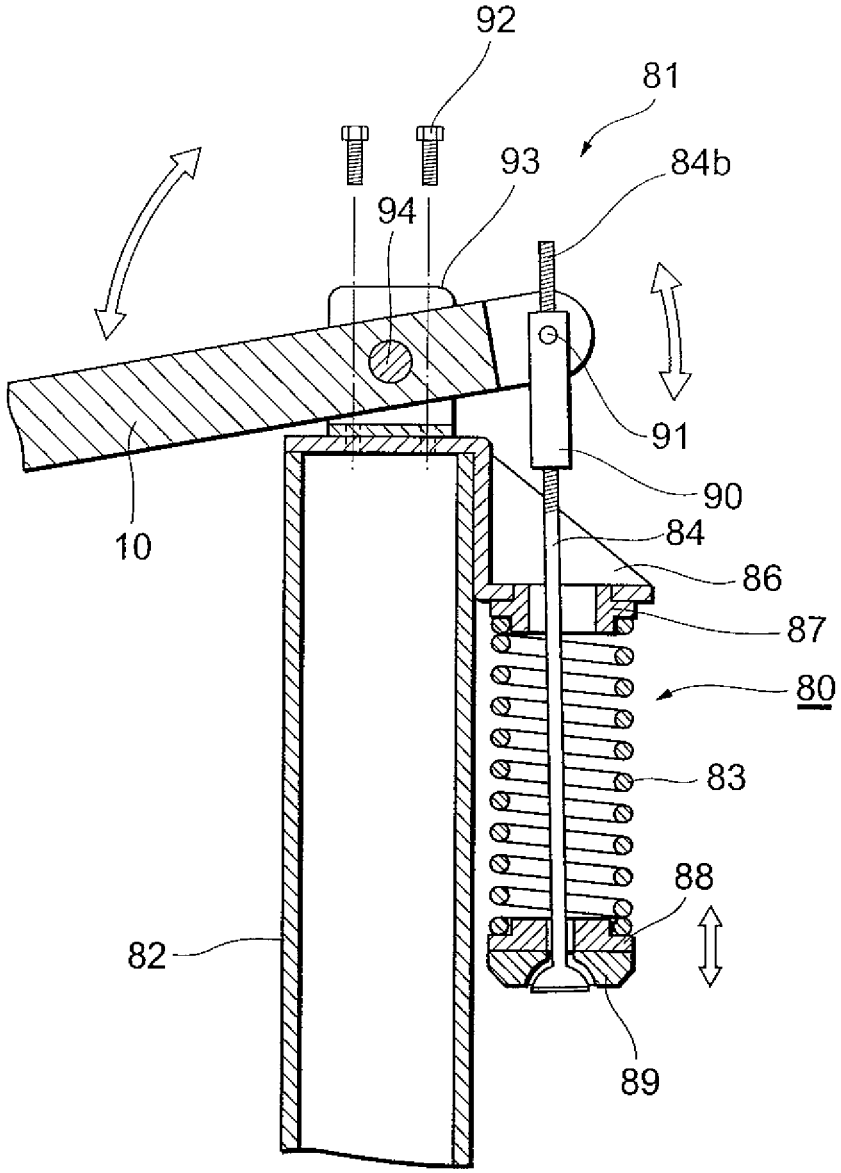
FIG. 12 is a cross section showing the main components in a third embodiment of the dishwasher according to the present invention.

As shown in FIG. 12, with the dishwasher 81 of the third embodiment, a compression spring 83 that is used for opening and closing the door 7 is fixed extending vertically to the a support tube 82 in the form of a rectangular pipe. The spring units 80 are each made up primarily of a rod 84 that extends in the vertical direction and is linked at its upper end to the proximal end of a rotary arm 10, a compression spring 83 through which the rod 84 passes and which extends in the vertical direction so as to be parallel with the rod 84, and a fixing member 86 that can be attached to or detached from a support tube 82, which supports the upper end of the compression spring 83 and forms part of the dishwasher main body 2.

Also, the upper ends of the compression springs 83 are positionally restricted by being pushed against the lower faces of the fixing members 86 which form attachment brackets, via a disc-shaped spring bearing 87. In contrast, the lower ends of the compression springs 83 are supported by the lower ends of the rods 84. Specifically, the lower ends of the compression springs 83 are supported by the lower ends of the rods 84 via disk-shaped spring bearings 88 and rod bearings 89.

Male threaded members 84*b* are formed on the upper end sides of the rods 84, and the male threaded members 84*b* are threaded into cylindrical female threaded members 90. This makes it easier to adjust spring pressure to suit the user's preference after assembly of the finished produced or after its installation. Cross-shaped holes (not shown) for a screwdriver are formed in the upper and lower ends of the rods 84.

The female threaded members 90 are rotatably linked to the proximal ends of the rotary arms 10 via shafts 91, and the rotary arms 10 are attached via shafts 94 to shaft bearings 93 fixed by screws 92 at the tops of the support tubes 82. The above-mentioned fixing members (attachment brackets) 86 are fixed by the screws 92 to the tops of the support tubes 82.

Also, cylindrical guide members (not shown) for guiding the springs 83 are integrally provided to the fixing members 86.

Fourth Embodiment

Figure 13:
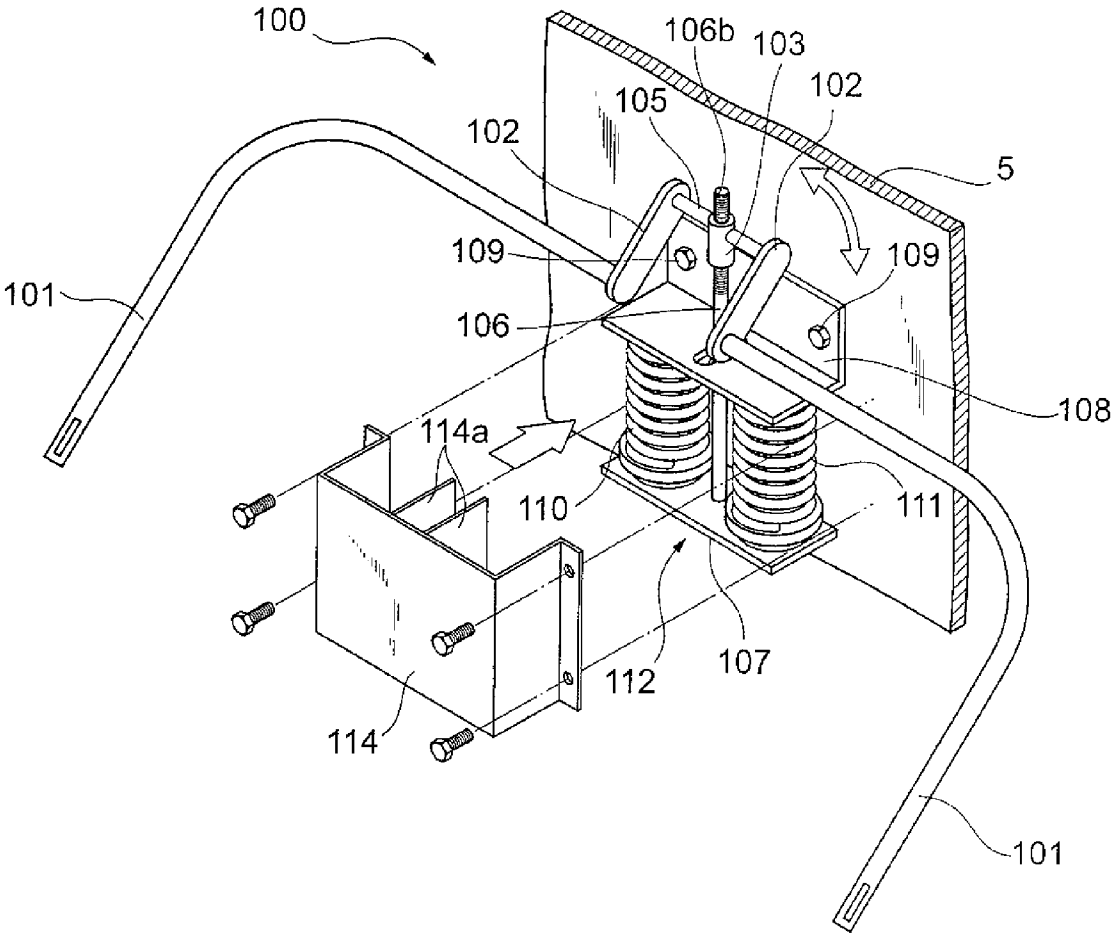
FIG. 13 is a cross section showing the main components in a fourth embodiment of the dishwasher according to the present invention.

As shown in FIG. 13, with the dishwasher 100 of the fourth embodiment, rotary arms 101 disposed along the side faces 7*a* of the door 7 in the washing chamber 3 are unlike the type described in the first to third embodiments in that they are disposed inside the washing chamber 3 and they function as operating levers. The distal ends of these rotary arms 101 swing to the side walls of the door 7, and the proximal ends of pivot pieces 102 are fixed to the proximal ends of the rotary arms 101. Also, the rotary arms 101 are rotatably supported by a shaft bearing provided to the rear panel 5. Female threaded members 103 are disposed between the left and right pivot pieces 102, and the distal ends of the pivot pieces 102 and a female threaded member 103 are linked by a support shaft 105.

A male threaded member 106*b* provided on the upper end side of a rod 106 is threaded into the female threaded member 103, and a lower spring bearing 107 is fixed to the lower ends of the rod 106. A pair of left and right compression springs 110 and 111 are sandwiched between the lower spring bearing 107 and an upper spring bearing (fixing member) 108 fixed by bolts 109 to the rear panel 5, and the rod 106 extends in the vertical direction between the pair of left and right compression springs 110 and 111.

Thus, a spring unit 112 is integrally equipped with the rod 106, the lower spring bearing 107, the upper spring bearing (fixing member) 108, and the compression springs 110 and 111, so the springs can be replaced merely by removing the bolts 109. Also, this spring unit 112 is installed inside the washing chamber 3. In view of this, the fact that washing water or the like would adhere to the compression springs 110 and 111 is taken into account, and the compression springs 110 and 111 are covered by a cover member (guide member) 114 that extends in the vertical direction. This cover member 114 has two partition plates 114*a* in its middle, and is bolted to the rear panel 5, so that the compression springs 110 and 111 expand and contract within this cover member 114.

Fifth Embodiment

As shown in FIGS. 14 to 19, with the dishwasher 151 of the fifth embodiment, spring units 150 are mounted inside hollow support tubes1 152. Each spring unit 150 is made up primarily of a rod 58 that extends in the vertical direction and whose upper end is linked to the proximal end side of the rotary arm 10, compression springs 53 and 54 that extends in the vertical direction and through which the rod 58 passes in parallel thereto, a fixing member 159 that can be attached to and detached from a support tube 152 that supports the upper end of the compression spring 53 and constitutes part of a dishwasher main body 2, and a guide cylinder 57 that extends in the vertical direction and houses the set of compression springs 53 and 54. The structure of the rods 58, the compression springs 53 and 54, and the guide cylinders 57 are the same as those in the second embodiment, and are therefore numbered the same and will not be described again.

The male threaded member 58*b* provided on the upper end side of the rod 58 is threaded into a cylindrical female threaded member 165. This allows the spring pressure to be easily adjusted as desired by the user, after assembly of the finished produced or after its installation The upper end portion of the rod 58 is formed with a hexagonal cross section. Since this hexagonal portion protrudes upward from the female threaded member 165, the spring pressure can be adjusted using a wrench. Further, a nut can be threaded onto the male threaded member 58*b* protruding from the upper end of the female threaded member 165 to prevent loosening.

Also, this female threaded member 165 is attached so as to pass in the vertical direction through the proximal end portion 166A of an arm joint 166 fixed to the proximal end of the rotary arm 10. A shaft pin 165*a* that protrudes horizontally is formed to the left and right of the upper end of the female threaded member 165, and a concave shaft hole 166*a* is formed in the interior of the proximal end portion 166A of the arm joint 166. With a ring-shaped shaft bearing 167 fitted to the shaft pin 165*a* of the female threaded member 165, the shaft bearing 167 is mounted from above in a shaft hole 166*a* in the arm joint 166, which reduces the pivoting effect of the arm joint 166 and allows a constant spring force to be exerted at all times on the arm joint 166.

Furthermore, an opening 159*a* that allows insertion from the front of an arm holder 169 is formed at the upper part of the front face of the fixing member 159, which constitutes a frame in the form of an open box section (a shape in which one of four sides is removed). A tab-shaped hook 169*a* that is inserted through the opening 159*a* in the fixing member 159 is provided to the rear face side of this arm holder 169. The distal end 169*b* of this hook 169*a* protrudes outward and is fitted into a catch hole 159*b* in the fixing member 159, which fixes the arm holder 169 to the fixing member 159.

A shaft hole 166*b* extending horizontally is provided in the approximate center of the arm joint 166, and a shaft hole 169*c* extending horizontally is provided in the approximate center of the arm holder 169. When the arm holder 169 fixed to the fixing member 159, the distal end side of the arm joint 166 is inserted from the rear into a through-hole 169*d* in the arm holder 169. After this, with the shaft hole 166*b* and the shaft hole 169*c* in position, a shaft pin 168 is inserted into the shaft holes 166*b* and 169*c*. The result is that the arm joint 166 is attached pivotably with respect to the arm holder 169. Also, an E ring 170 is fitted to the distal end of the shaft pin 168 to keep the shaft pin 168 from coming loose.

Also, with the shaft hole 57*b* provided at the lower end of the guide cylinder 57 aligned with a shaft hole 159*c* provided at the lower end of the fixing member 159, a shaft pin 163 is inserted into the shaft holes 57*b* and 159*c*. The result is that the lower end of the guide cylinder 57 is attached pivotably with respect to the fixing member 159. Also, an E ring 171 is fitted to the distal end of the shaft pin 163 to keep the shaft pin 163 from coming loose.

Figure 14:
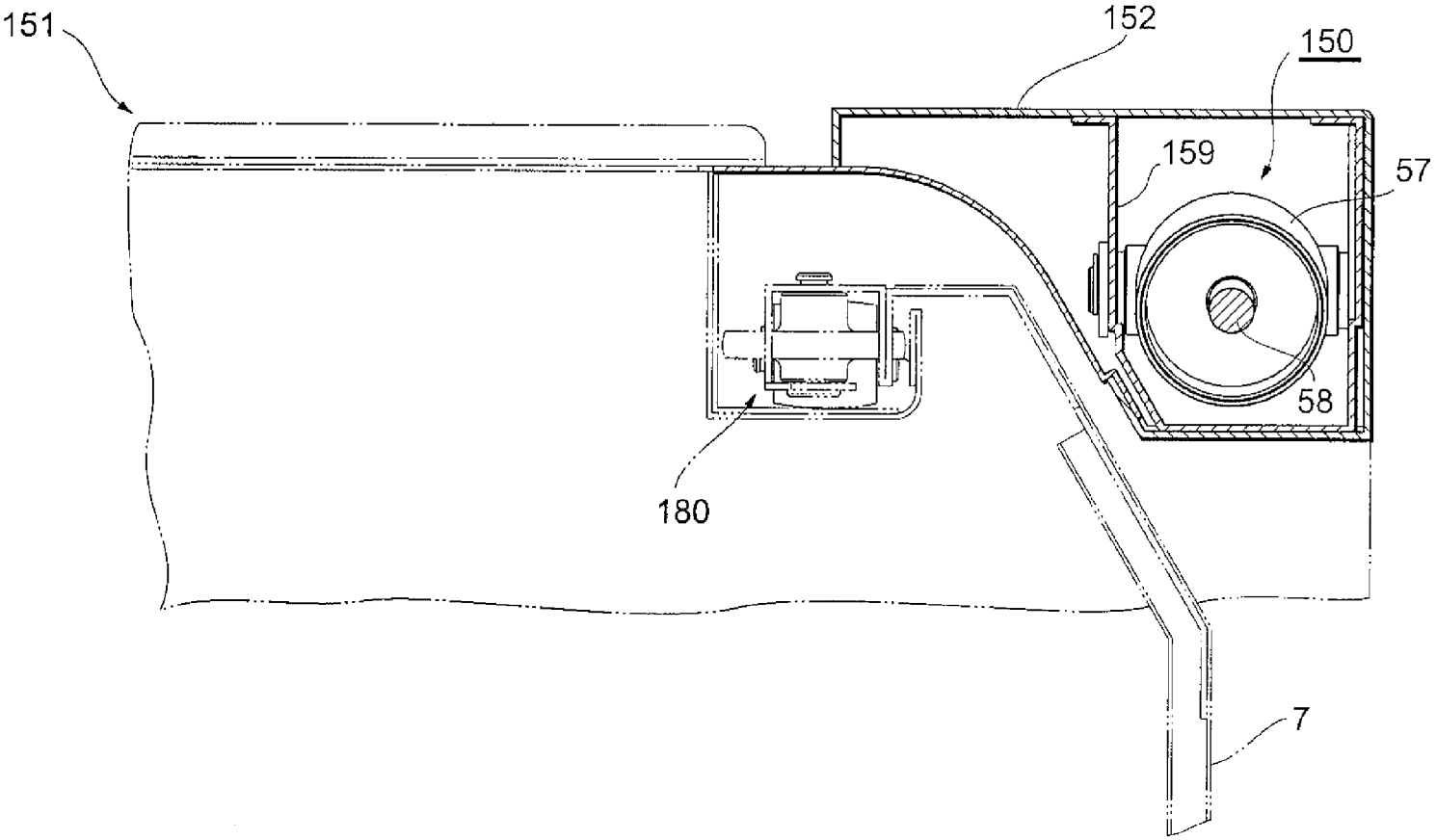
FIG. 14 is a cross section showing the main components in a fifth embodiment of the dishwasher according to the present invention.
Figure 15:
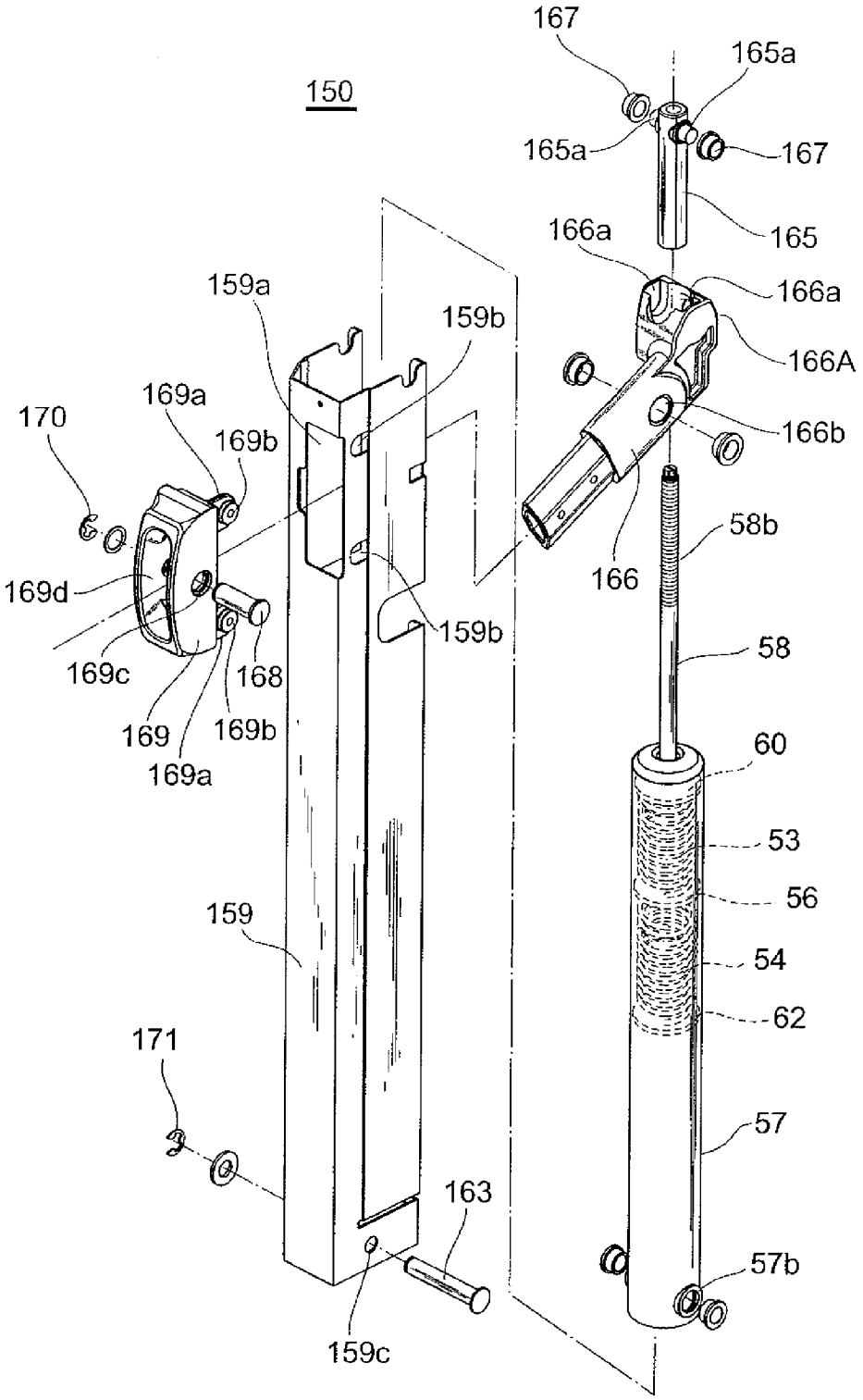
FIG. 15 is an exploded oblique view of the spring unit applied to the dishwasher shown in FIG. 14.
Figure 16:
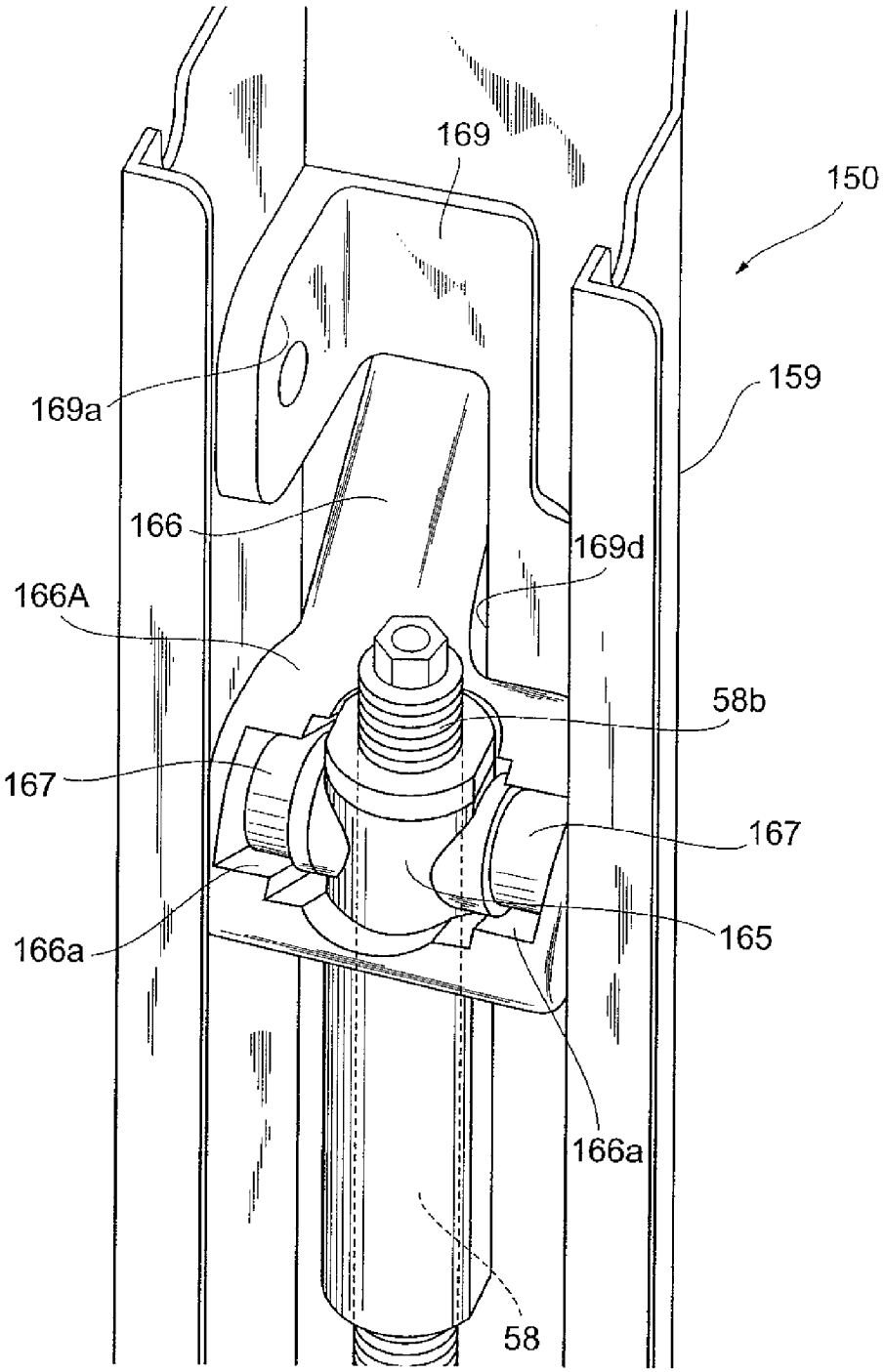
FIG. 16 is a detail oblique view of the main components of the spring unit.
Figure 17:
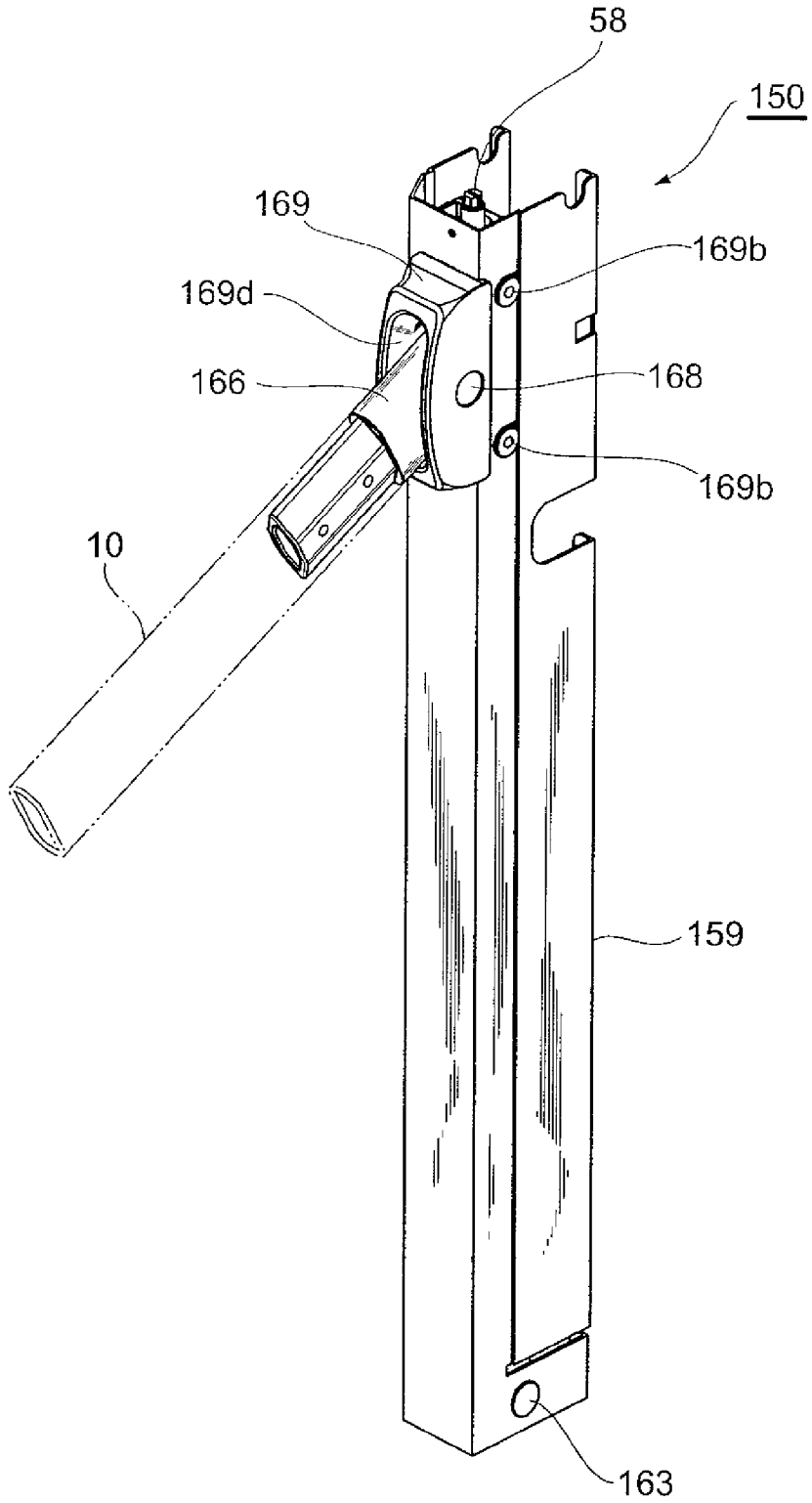
FIG. 17 is an oblique view showing the outside of the spring unit.
Figure 18:
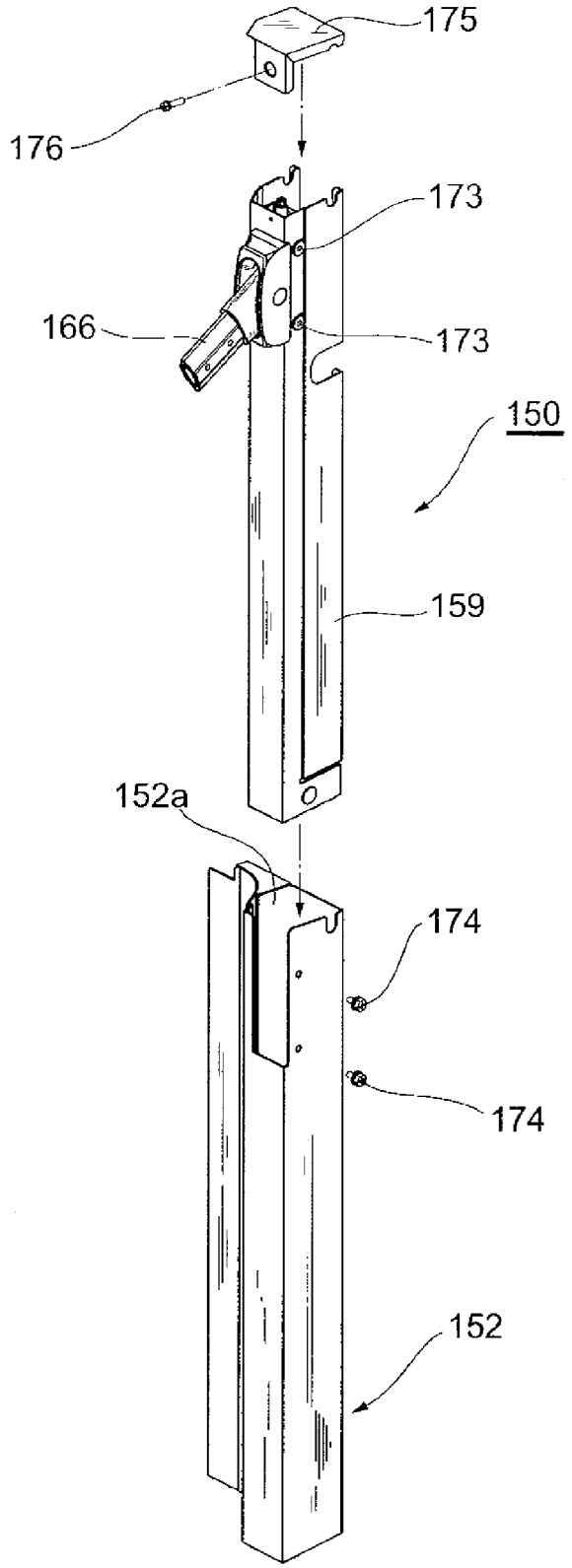
FIG. 18 is an exploded oblique view of the spring unit before it is fitted into its support tube.
Figure 19:
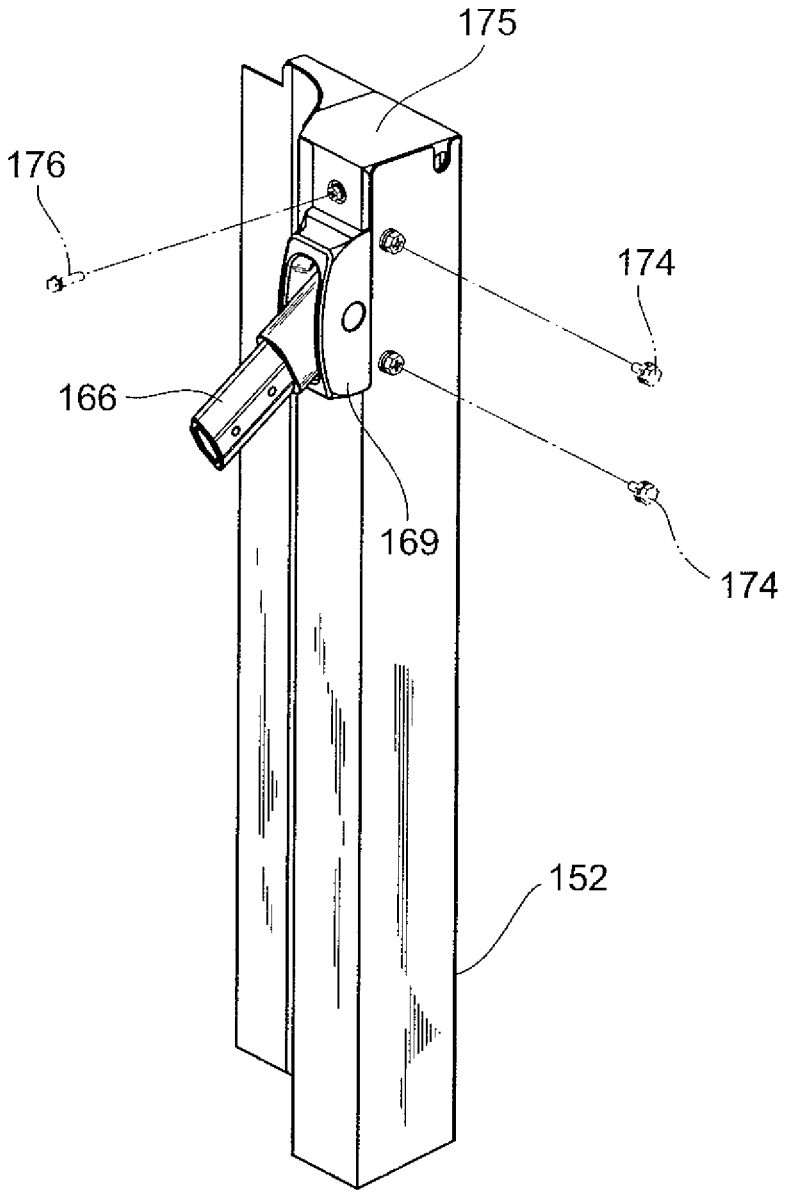
FIG. 19 is an oblique view of the spring unit after it has been fitted into its support tube.

Next, the process of assembling spring units 150 with this structure (see FIG. 17) into the support tubes 152 will be described. As shown in FIGS. 18 and 19, the fixing member 159 of a spring unit 150 is inserted from above in an upper end opening 152*a* of the support tube 152. After this, a screw 174 is threaded into a screw hole 173 provided at the distal end 169*b* of the hook 169*a* of the spring unit 150, thereby fixing the spring unit 150 to the support tube 152. Threading in this screw 174 simultaneously fixes the arm holder 169 and the fixing member 159 to the support tube 152. After this, a cap 175 is fixed to the top of the fixing member 159 of the spring unit 150 with a screw 176. In FIG. 14, 180 is a guide means for guiding the up and down motion of the door 7.

In this fifth embodiment, most of the assembled structure involves insertion or fitting, so both assembly and maintenance are easy. Also, there are few fasteners such as bolts and screws, which is also advantageous in terms of assembly and maintenance.

The dishwasher according to the present invention is not limited to the embodiments stated above. For instance, the above-mentioned spring bearings 36 and 37, spacers 56, and spring bearings 60, 62, 87, and 88 are made from plastic to improve sliding and reduce noise. Also, in the second and fifth embodiments, rather than there being two springs, there may be just one, or there may be three or more.

The invention claimed is:

1. A dishwasher, in which a washing chamber provided on the side of a dishwasher main body is opened and closed by moving a door up and down while rotating a rotary arm disposed on a side face of the door, the dishwasher comprising:

a spring unit detachable from the dishwasher main body, the spring unit integrally including a fixing member, a rod, and a compression spring; and a female threaded member attached to the proximal end side of the rotary arm, wherein a male threaded member is formed at the upper end of the rod, and the male threaded member is threaded into the female threaded member, wherein the rod extends in a vertical direction and is linked at an upper end to the proximal end of the rotary arm, wherein the compression spring extends in a vertical direction, wherein the compression spring is disposed substantially parallel to the rod, wherein an upper end of the compression spring is supported in a state of being restricted with respect to the dishwasher main body, wherein a lower end of the compression spring is supported by a lower end of the rod, wherein the fixing member supports the compression spring, wherein the fixing member is removable from an upper opening at a top of a support tube arranged in the dishwasher main body in the vertical direction, wherein the support tube is shaped such that a space inside thereof is pipe shaped, and wherein a cap, configured to open/close the opening of the support tube, is fixed to the opening of the support tube.

2. The dishwasher according to claim 1, further comprising a female threaded member attached to the proximal end side of the rotary arm, wherein a male threaded member is formed at the upper end of the rod, and the male threaded member is threaded into the female threaded member.

3. The dishwasher according to claim 2, further comprising a guide member that accommodates the compression spring.

4. The dishwasher according to claim 1, further comprising a guide member that accommodates the compression spring.

5. The dishwasher according to claim 1, further comprising a guide member that accommodates the compression spring.

6. A dishwasher, in which a washing chamber provided on the side of a dishwasher main body is opened and closed by moving a door up and down while rotating a rotary arm disposed on a side face of the door, the dishwasher comprising:

a spring unit detachable from the dishwasher main body, the spring unit integrally including a fixing member, a rod, and a compression spring, wherein the rod extends in a vertical direction and is linked at an upper end to the proximal end of the rotary arm, wherein the compression spring extends in a vertical direction, wherein the compression spring is disposed substantially parallel to the rod, wherein an upper end of the compression spring is supported in a state of being restricted with respect to the dishwasher main body, wherein a lower end is supported by the lower end of the rod, wherein the fixing member supports the compression spring, wherein the fixing member is removable from an upper opening of a support tube arranged in the dishwasher main body in the vertical direction, wherein a guide cylinder accommodates the compression springs, wherein the guide cylinder is linked with the fixing member by way of a shaft pin passing through two shaft holes of the guide cylinder and two shaft holes of the fixing member, and wherein the assembly of the guide cylinder and the fixing member is further accommodated in the support tube.

* * * * *